US009108071B2

(12) United States Patent
Conde, Jr.

(10) Patent No.: US 9,108,071 B2
(45) Date of Patent: Aug. 18, 2015

(54) DEPLOYABLE FIRE ESCAPE WITH MULTIPLE ALTERNATING RAMPS

(71) Applicant: Jose Conde, Jr., Whitestone, NY (US)

(72) Inventor: Jose Conde, Jr., Whitestone, NY (US)

( * ) Notice: Subject to any disclaimer, the term of this patent is extended or adjusted under 35 U.S.C. 154(b) by 261 days.

(21) Appl. No.: 13/851,794

(22) Filed: Mar. 27, 2013

(65) Prior Publication Data

US 2014/0291071 A1 Oct. 2, 2014

(51) Int. Cl.

| | |
|---|---|
| ***A62B 1/00*** | (2006.01) |
| ***A62B 1/02*** | (2006.01) |
| ***A62B 1/20*** | (2006.01) |
| *E06C 9/14* | (2006.01) |

(52) U.S. Cl.

CPC ... *A62B 1/02* (2013.01); *A62B 1/00* (2013.01); *A62B 1/20* (2013.01); *E06C 9/14* (2013.01)

(58) Field of Classification Search

CPC ..... E06C 9/00; E06C 9/06; E06C 9/08; E06C 9/085; E06C 9/10; E06C 9/12; E06C 9/14; A62B 1/00; A62B 1/02; A62B 1/20; A62B 5/00

USPC ..... 182/70, 76, 93, 95, 195, 96, 101, 182/130–132, 48, 49

See application file for complete search history.

(56) References Cited

U.S. PATENT DOCUMENTS

| | | | | | |
|---|---|---|---|---|---|
| 280,527 | A * | 7/1883 | Smiley | 182/18 |
| 299,833 | A * | 6/1884 | Mott, Jr. | 182/94 |
| 597,706 | A * | 1/1898 | Brown | 182/95 |
| 1,218,828 | A * | 3/1917 | Barber et al. | 182/85 |
| 2,905,261 | A * | 9/1959 | McConologue | 182/85 |
| 3,180,451 | A * | 4/1965 | Patterson | 182/106 |
| 3,263,773 | A * | 8/1966 | Sallein | 182/158 |
| 4,732,235 | A * | 3/1988 | Reed | 182/142 |
| 4,865,155 | A * | 9/1989 | Montaigne et al. | 182/14 |
| 5,303,799 | A * | 4/1994 | Tsai | 182/78 |
| 5,311,965 | A * | 5/1994 | Wu | 182/85 |
| 5,927,434 | A * | 7/1999 | Wu | 182/95 |
| 6,467,575 | B1 * | 10/2002 | Chen | 182/48 |
| 2003/0070874 | A1 * | 4/2003 | Kim | 182/82 |
| 2004/0256179 | A1 * | 12/2004 | Deplazes et al. | 187/249 |
| 2006/0054420 | A1 * | 3/2006 | Gordon et al. | 187/313 |
| 2008/0035425 | A1 * | 2/2008 | Meitus et al. | 182/129 |
| 2008/0053750 | A1 * | 3/2008 | Tseng et al. | 182/82 |
| 2008/0116007 | A1 * | 5/2008 | Johnson | 182/49 |
| 2008/0190704 | A1 * | 8/2008 | Moses et al. | 187/247 |
| 2009/0100614 | A1 * | 4/2009 | Dale et al. | 14/71.3 |
| 2011/0000742 | A1 * | 1/2011 | Hafliger et al. | 182/42 |
| 2012/0241252 | A1 * | 9/2012 | Urban | 182/48 |

* cited by examiner

*Primary Examiner* — Daniel Cahn

(57) ABSTRACT

A deployable fire escape with multiple alternating ramps allows a user to evacuate a building without needing the use of their lower body by walking or climbing. A plurality of alternating ramps are supported by a scissor mechanism that is engaged within guide channels of two fixed guide rails. The scissor mechanism is composed of a number of scissor sections, the number of which depends on the height of the building to be evacuated from. Each of the ramps is made from an upper layer and a lower layer of wide, flexible ramp belts, with the upper belts being staggered with the lower belts. Intermediate platforms allow the user to rest or reorient themselves. The user alternatingly slides down a ramp, pries apart the belts of the ramp, and climbs through the gap in the ramp belts to the next ramp, repeating this process until reaching the ground level.

12 Claims, 8 Drawing Sheets

DEPLOYABLE FIRE ESCAPE WITH MULTIPLE ALTERNATING RAMPS

FIELD OF THE INVENTION

The present invention relates generally to building evacuation. More particularly, the present invention relates to a mechanical fire escape that facilitates evacuating a building without walking.

BACKGROUND OF THE INVENTION

A fire escape is a special kind of emergency exit, usually mounted to the outside of a building or occasionally inside but separate from the main areas of the building. It provides a method of escape in the event of a fire or other emergency that makes the stairwells inside a building inaccessible. Fire escapes are most often found on multiple-story residential buildings, such as apartment buildings. They are commonly a very important aspect of fire safety for construction in urban areas.

Traditional fire escapes consist of a number of horizontal platforms, one at each story of a building, with ladders or stairs connecting the platforms. Railings are usually provided on each of the levels, but as fire escapes are designed for emergency use only, these railings often do not meet the same standards as railings in other contexts. The ladder from the lowest level of the fire escape may be fixed, but commonly swings down on a hinge or slides along a track.

Traditional fire escapes are limited to being a form of egress that adds a substantial load on any building façade, creating points of deterioration and entry of water along the fire escape due to the union of steel and masonry. Additionally, the user of a traditional fire escape requires being physically capable of walking or climbing down the fire escape. Due to this limitation, persons who are not able-bodied enough to use a traditional fire escape in an emergency situation are at a higher risk of suffering injury or death in an emergency situation. Therefore, extended care and emergency facilities must perform special operations to rescue those who are unable to facilitate their own evacuation, increasing risk for both those who are in need of rescue as well as emergency personnel performing the rescue.

It is therefore an object of the present invention to provide a mechanical system that does not require the use of one's lower body to evacuate a building, and does not impose a substantial load on a building façade. The present invention provides an evacuation method by sliding down several belts that do not require the use of one's lower body. If a rescuer is performing a rescue utilizing the present invention, the rescuer does not require the levels of strength needed to carry the victim in order to perform the rescue, conserving energy and facilitating an effective rescue.

DETAIL DESCRIPTIONS OF THE INVENTION

All illustrations of the drawings are for the purpose of describing selected versions of the present invention and are not intended to limit the scope of the present invention.

The present invention is a mechanical deployable fire escape designed to be compact prior to release and that facilitates the ability to evacuate a building without requiring the use of walking, taking stairs or other exertion of the lower body. The present invention provides a plurality of alternating ramps 400 to allow a user to slide down from level to level, continuing until contacting the ground level. Each of the plurality of alternating ramps 400 is made of a number of wide, flexible belt sections. The user pulls apart the flexible belt sections and forces their body between the flexible belt sections in order to pass through one ramp to the next ramp. The user may rest between the alternating ramps on intermediate platforms. To clarify, the flexible belt sections form the sloped surface of each of the alternating ramps on which the user slides. The present invention is intended to be installed on a building façade 100, at the level of the window of a residence.

Figure 1:
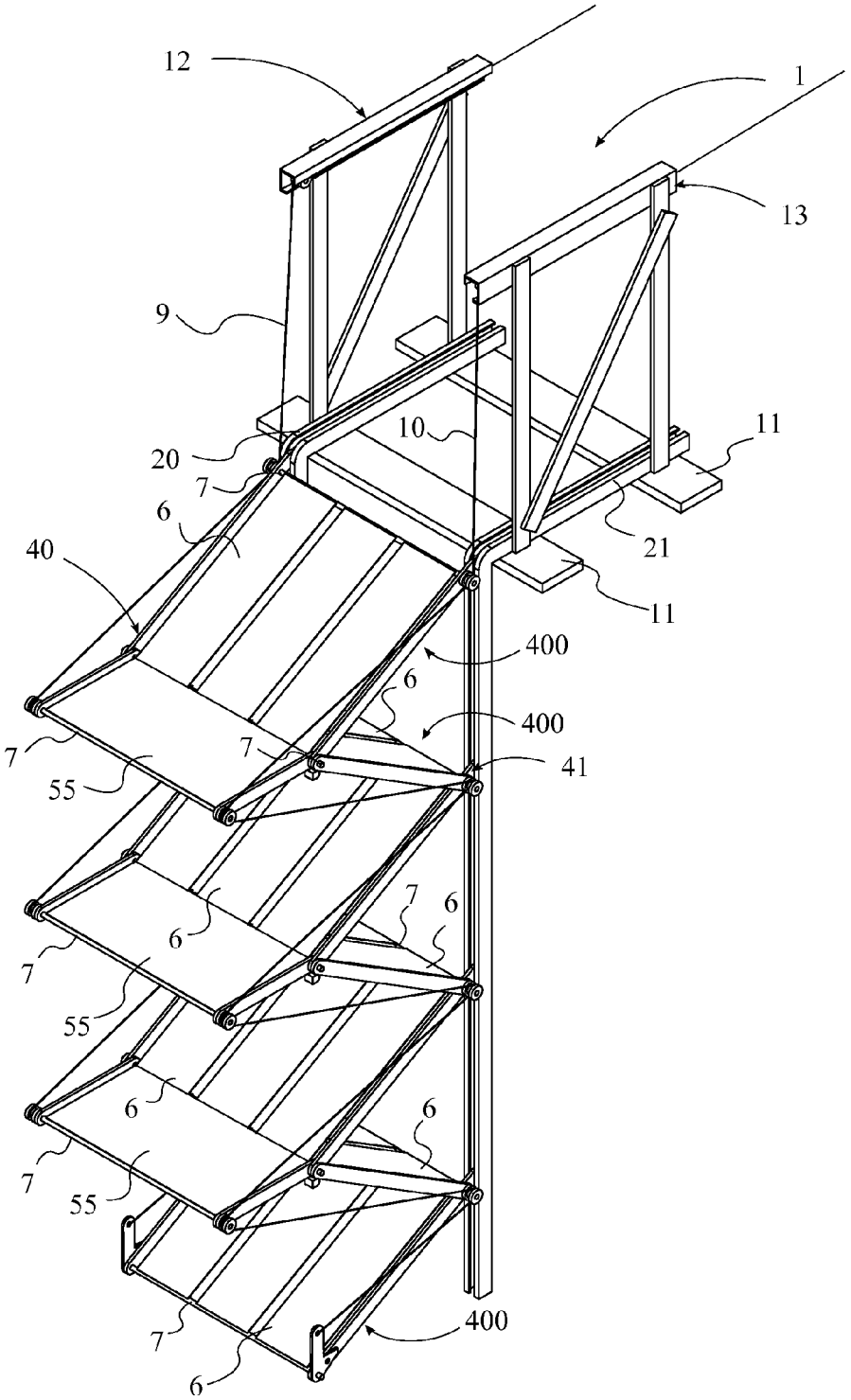
FIG. 1 is a perspective view of the present invention in the deployed configuration.

Referring to FIG. 1, the present invention generally comprises a storage area 1, a left fixed guide rail 20, a right fixed guide rail 21, a left scissor mechanism 40, a right scissor mechanism 41, a plurality of ramp belt sections 6, a plurality of crossbars 7, at least one platform panel 55, a left cable 9, and a right cable 10. In the preferred embodiment of the present invention, all of the components of the present invention are made of steel, aluminum, titanium, another appropriate metal, a non-metal material that is sufficiently strong to withstand the forces applied to the present invention, or any combination of said materials that accomplishes the purpose of the present invention.

Figure 2:
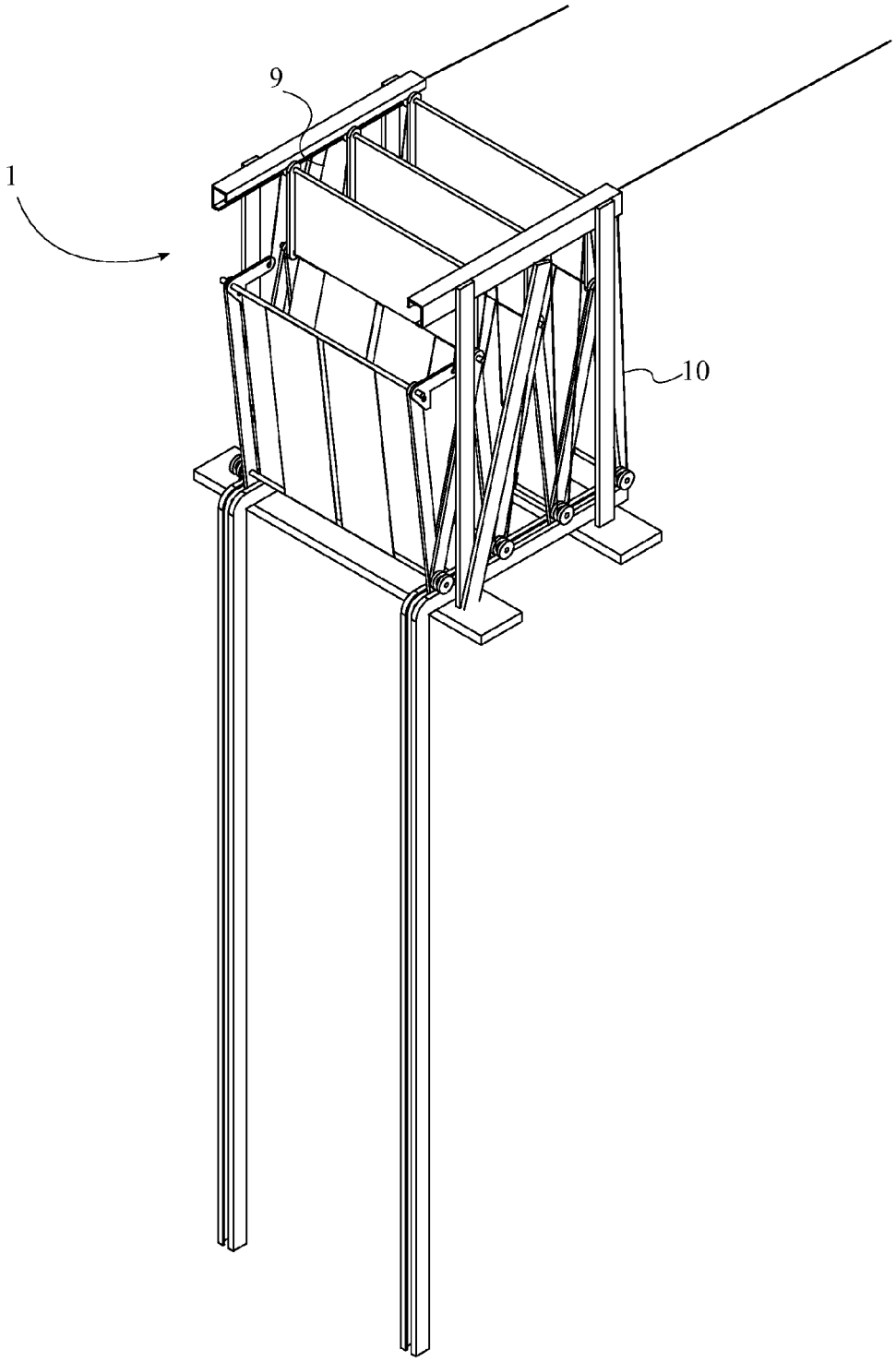
FIG. 2 is a perspective view of the present invention in the stored configuration.

The storage area 1 is the topmost portion of the present invention where a user enters the plurality of alternating ramps 400 to begin their descent to the ground using the present invention. As seen in FIG. 2, the storage area 1 also functions to store the ramps when not in use. The storage area 1 comprises a deck support 11, a left railing 12, and a right railing 13. The left railing 12 and the right railing 13 are oriented parallel to each other. The left railing 12 and the right railing 13 are perpendicularly attached to the deck support 11. When the plurality of alternating ramps 400 is folded and stored in the storage area 1, each of the alternating ramps is held in an upright position within the storage area 1.

Figure 3:
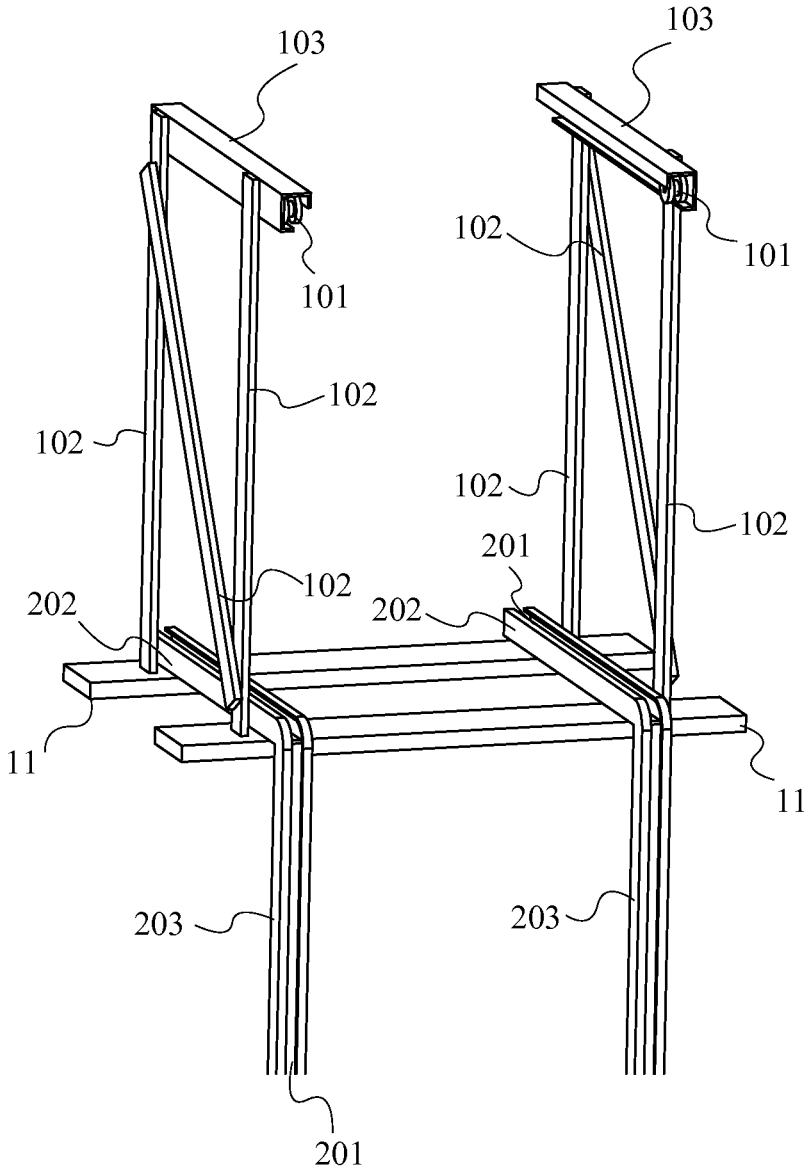
FIG. 3 is a perspective view of only the storage area and the fixed guide rails.

Referring to FIG. 3, the left railing 12 and the right railing 13 each further comprise a plurality of railing supports 102, a hollow horizontal bar 103 and a railing pulley 101. The plurality of railing supports 102 is perpendicularly attached between the deck support 11 and the hollow horizontal bar 103, and the railing pulley 101 is positioned within the hollow horizontal bar 103.

The left fixed guide rail 20 and the right fixed guide rail 21 each comprise a guide channel 201, a horizontal portion 202, and a vertical portion 203. The horizontal portion 202 is perpendicularly connected to the vertical portion 203, forming a right angle between the horizontal portion 202 and the vertical portion 203. The horizontal portion 202 is oriented parallel to the deck support 11 and is positioned within the storage area 1.

The horizontal portion 202 of the left fixed guide fail is attached to the deck support 11 adjacent to the left railing 12. The horizontal portion 202 of the right fixed guide rail 21 is attached to the deck support 11 adjacent to the right railing 13. The horizontal portion 202 of the left fixed guide rail 20 is parallel to the horizontal portion 202 of the right fixed guide rail 21, and the vertical portion 203 of the left fixed guide rail 20 is oriented parallel to the vertical portion 203 of the right fixed guide rail 21. The guide channel 201 traverses continuously across the vertical portion 203 and the horizontal portion 202. The inside of the guide channel 201 has a width that is greater than the width of the opening of the guide channel 201.

Figure 4:
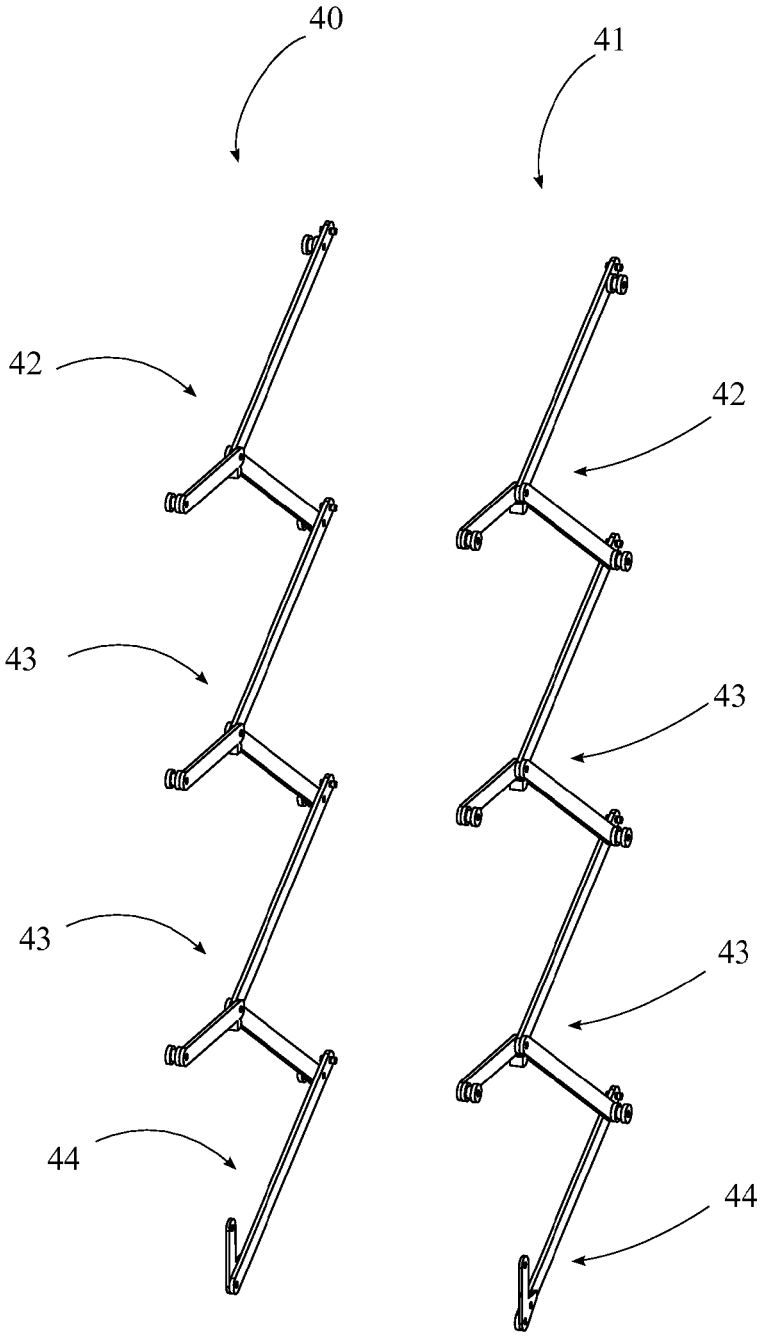
FIG. 4 is a perspective view of only the left scissor mechanism and the right scissor mechanism.

Referring to FIG. 4, the left scissor mechanism 40 and the right scissor mechanism 41 are a series of linkages that form the supporting structure for the plurality of alternating ramps 400 and the at least one platform panel 55. The left scissor mechanism 40 and the right scissor mechanism 41 are identical, with the exception that the left scissor mechanism 40 is a mirror image of the right scissor mechanism 41. The left scissor mechanism 40 and the right scissor mechanism 41 are constrained by the left fixed guide rail 20 and the right fixed guide rail 21, respectively, and by the left cable 9 and the right cable 10, respectively.

The left scissor mechanism 40 is pivotally and translationally engaged with the left fixed guide rail 20. That is, certain components of the left scissor mechanism 40 are engaged with the left fixed guide rail 20, pivot with respect to the left fixed guide rail 20 and are allowed to translate in a parallel manner along the left fixed guide rail 20. Similarly, the right scissor mechanism 41 is pivotally and translationally engaged with the right fixed guide rail 21.

As can be seen in FIG. 4, the left scissor mechanism 40 and the right scissor mechanism 41 each comprise a first scissor section 42, at least one subsequent scissor section 43, and a last scissor section 44. The first scissor section 42, the at least one subsequent scissor section 43 and the last scissor section 44 are pivotally connected to each other in series. The first scissor section 42 and the at least one subsequent scissor section 43 are identical and each are comprised of two of the plurality of alternating ramps 400, one sloping away from the building façade 100, and one sloping toward the façade 100, forming a triangular shape. The first scissor section 42, the at least one subsequent scissor section 43 and the last scissor section 44 create a zigzag formation when viewed from a lateral vantage point. In the preferred embodiment of the present invention, the at least one subsequent scissor section 43 comprises more than one scissor section. In an alternate embodiment of the present invention, the at least one subsequent scissor section 43 is not included, resulting in three ramps: two in the first scissor section 42, and one in the last scissor section 44. In the application of the present invention, the number of scissor sections comprised in the at least one subsequent scissor section 43 will depend on the height of the building.

As can be seen in FIGS. 4-7, the first scissor section 42, the at least one subsequent scissor section 43, and the last scissor section 44 each comprise a first pulley 50, an upper ramp support arm 52, and a roller pin 53. The first scissor section 42 and the at least one subsequent scissor section 43 each further comprise a second pulley 51, a lower ramp support arm 54, and a platform support arm 56. The last scissor section 44 further comprises a cable securing rod 57.

The following descriptions of the first pulley 50, the upper ramp support arm 52, and the roller pin 53 apply to the first pulley 50, the upper ramp support arm 52, and the roller pin 53, respectively, of each of the first scissor section 42, the at least one subsequent scissor section 43, and the last scissor section 44 for each of the left scissor mechanism 40 and the right scissor mechanism 41, except where otherwise specified.

The descriptions of the second pulley 51, the lower ramp support arm 54, and the platform support arm 56 apply to the second pulley 51, the lower ramp support arm 54, and the platform support arm 56, respectively, of each of the first scissor section 42 and the at least one subsequent scissor section 43 for each of the left scissor mechanism 40 and the right scissor mechanism 41, except where otherwise specified.

The roller pin 53 is the component of the present invention that constrains the plurality of alternating ramps 400 against the left fixed guide rail 20 and the right fixed guide rail 21. The roller pin 53 comprises a first wheel 531 and a second wheel 532. The roller pin 53 is positioned perpendicular to the upper ramp support arm 52, and is positioned symmetrically across the upper ramp support arm 52 at the roller attachment location 523, so that the first wheel 531 and the second wheel 532 are symmetrically separated by the upper ramp support arm 52. The first wheel 531 of the left scissor mechanism 40 and the second wheel 532 of the left scissor mechanism 40 are rollingly engaged inside the left fixed guide rail 20, so that the roller pin 53 of the left scissor mechanism 40 holds the left scissor mechanism 40 adjacent to the left fixed guide rail 20. FIGURE Similarly, the first wheel 531 of the right scissor mechanism 41 and the second wheel 532 of the right scissor mechanism 41 are rollingly engaged inside the right fixed guide rail 21, so that the roller pin 53 of the right scissor mechanism 41 holds the right scissor mechanism 41 adjacent to the right fixed guide rail 21.

Figure 6:
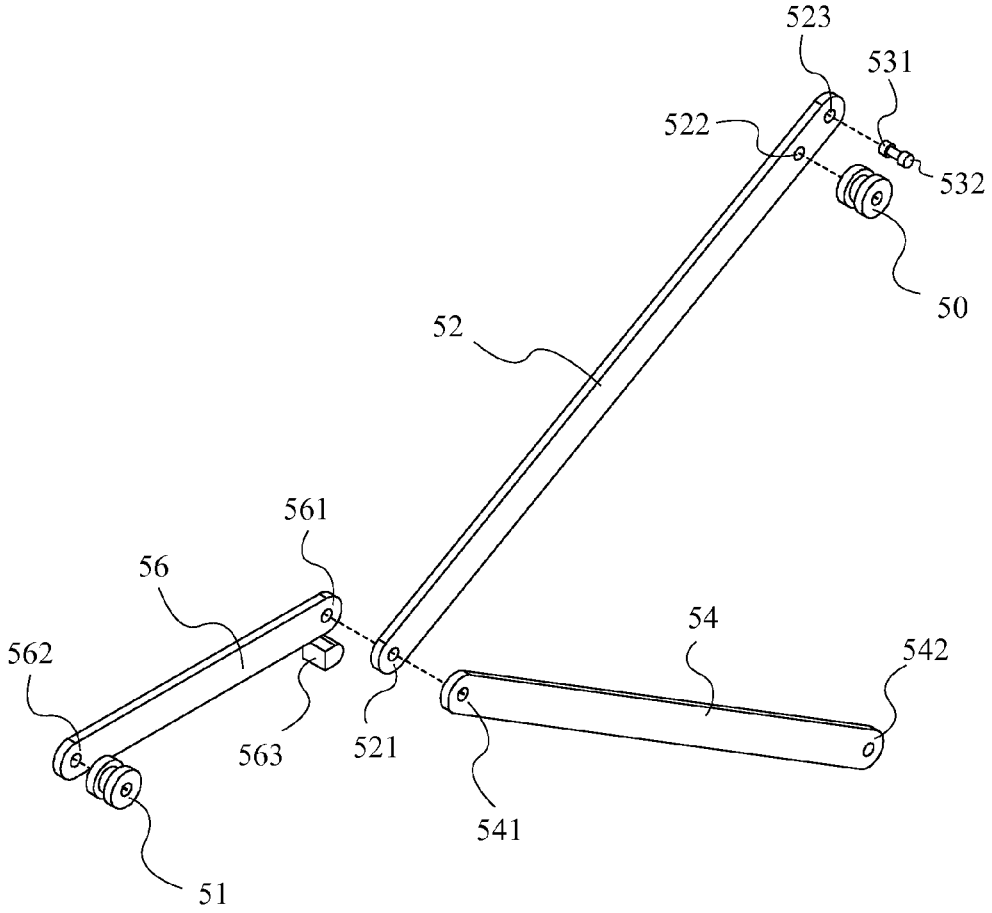
FIG. 6 is a perspective exploded view of the structure of one of the scissor sections.
Figure 7:
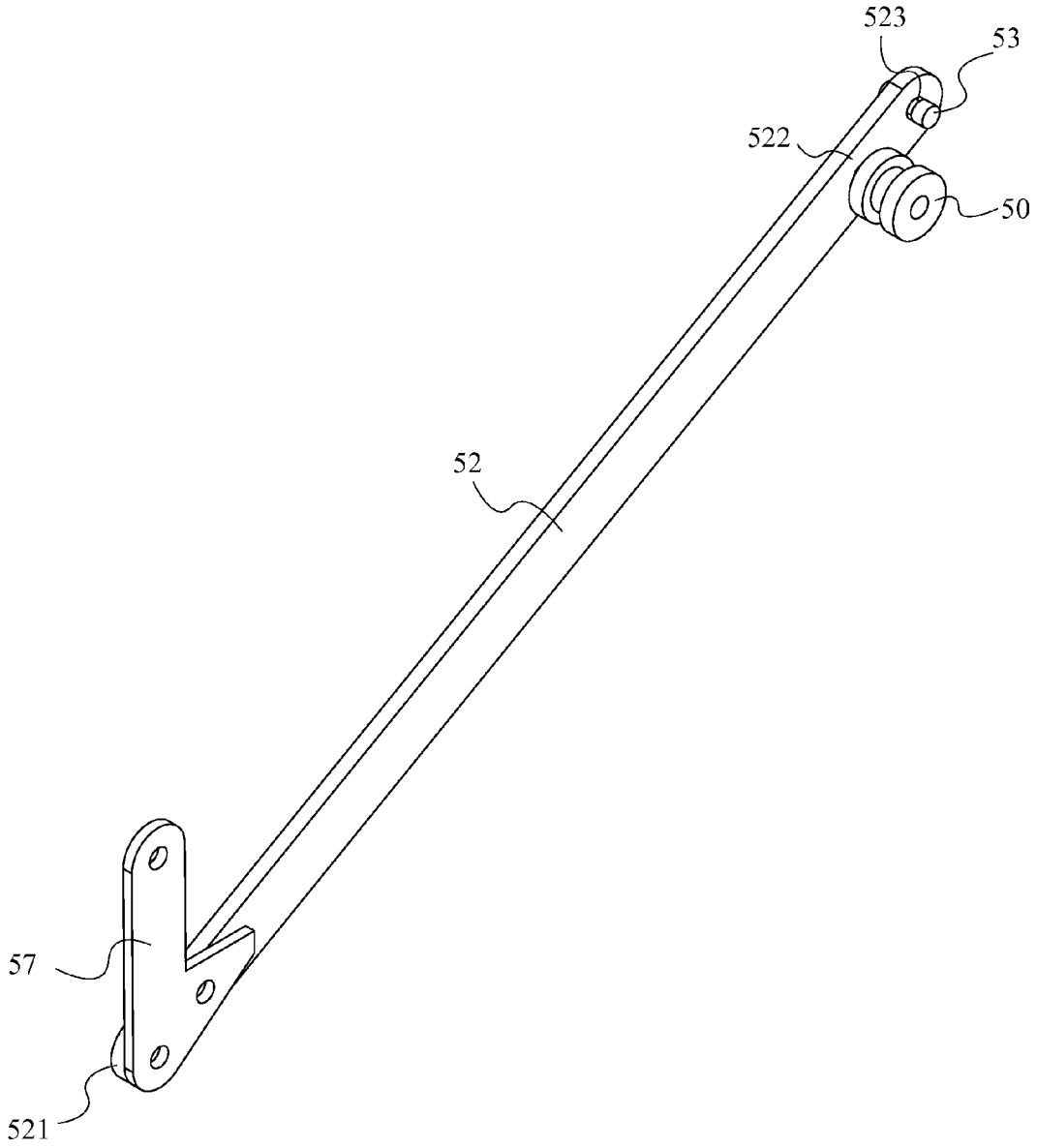
FIG. 7 is a perspective view of the last scissor section.

Referring to FIG. 6, the upper ramp support arm 52 comprises a first upper arm end 521, a second upper arm end 522 and a roller attachment location 523. The lower ramp support arm 54 comprises a first lower arm end 541 and a second lower arm end 542. The platform support arm 56 comprises a first platform arm end 561 a second platform arm end 562, and a supporting protrusion 563.

The first upper arm end 521 is positioned opposite the second upper arm end 522 along the upper ramp support arm 52. The roller attachment location 523 is positioned adjacent to the second upper arm end 522 opposite the first upper arm end 521. The first lower arm end 541 is positioned opposite the second lower arm end 542 along the lower ramp support arm 54. The first platform arm end 561 is positioned opposite the second platform arm end 562 along the platform support arm 56. The supporting protrusion 563 is positioned on the underside of the platform support arm 56 adjacent to the first platform arm end 561. The supporting protrusion 563 extends from the platform support arm 56 and presses against the lower ramp support arm 54 in order to support the platform support arm 56 in a horizontal orientation while the present invention is in the deployed position.

Figure 5:
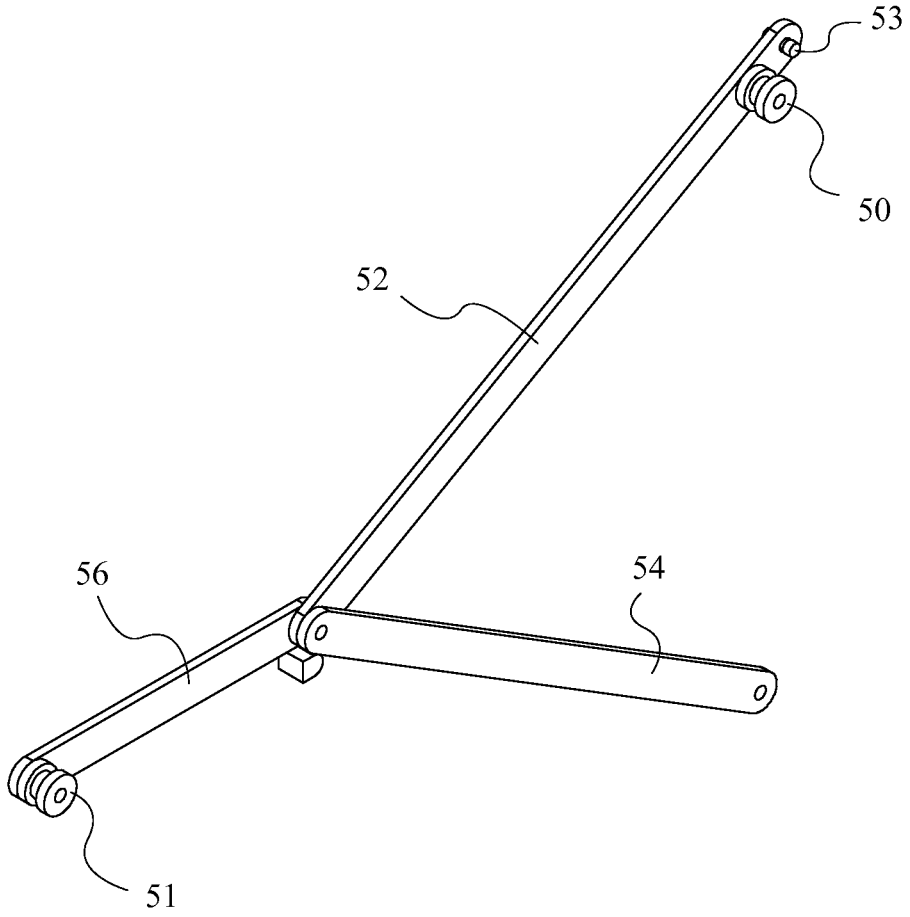
FIG. 5 is a perspective view of the structure of one of the scissor sections.

Referring to FIGS. 5-6, the first upper arm end 521, the first lower arm end 541 and the first platform arm end 561 are pivotally connected to each other for each of the first scissor section 42 and the at least one subsequent scissor section 43. The first pulley 50 is rotatably connected to the second upper arm end 522, and the second pulley 51 is rotatably connected to the second platform arm end 562.

Referring to FIGS. 4, 5, 6 and 8, the second upper arm end 522 of the at least one subsequent scissor section 43 is pivotally connected to the second lower arm end 542 of the lower ramp support arm 54 of a previous scissor section 200. The previous scissor section 200 is either one of the at least one subsequent scissor section 43, or the previous scissor section 200 is the first scissor section 42.

The second upper arm end 522 of the last scissor section 44 is pivotally connected to the second lower arm end 542 of the lower ramp support arm 54 of a previous scissor section 200, wherein the previous scissor section 200 is one of the at least one subsequent scissor section 43*s*.

Figure 8:
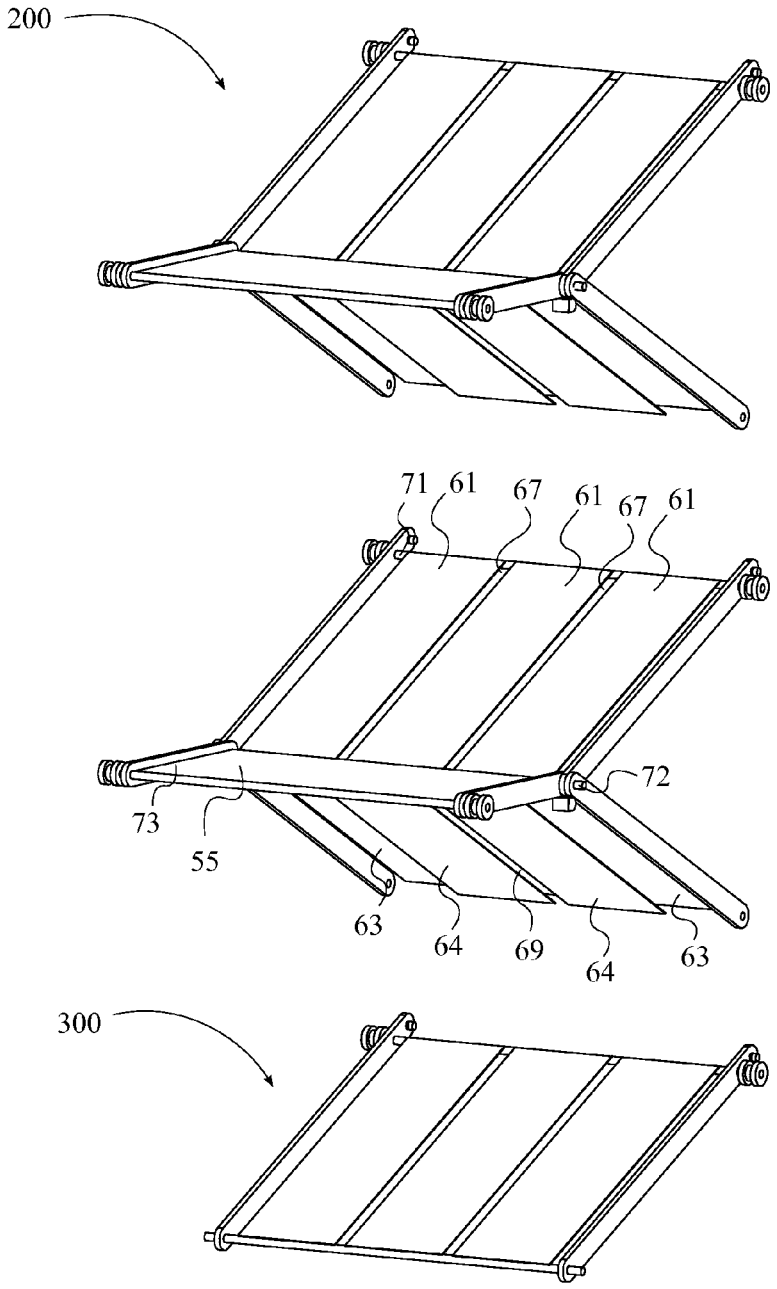
FIG. 8 is a perspective view depicting an intermediate scissor section, its ramp belts and crossbars, and its relationships with a previous scissor section and a next scissor section.

Referring to FIGS. 4, 6, and 8 the plurality of crossbars 7 are oriented parallel to each other and are oriented perpendicular to the left scissor mechanism 40 and to the right scissor mechanism 41. The plurality of crossbars 7 comprises a first crossbar 71, a second crossbar 72, and a third crossbar 73. The first crossbar 71 is rotatably connected in between the second upper arm end 522 of the left scissor mechanism 40 and the second upper arm end 522 of the right scissor mechanism 41 for each of the first scissor section 42, the at least one subsequent scissor section 43, and the last scissor section 44. The second crossbar 72 is rotatably connected in between the first upper arm end 521 of the left scissor mechanism 40 and the first upper arm end 521 of the right scissor mechanism 41 for each of the first scissor section 42, the at least one subsequent scissor section 43, and the last scissor section 44. The third crossbar 73 is rotatably connected between the second platform arm end 562 of the left scissor mechanism 40 and the second platform arm end 562 of the right scissor mechanism 41 for each of the first scissor section 42 and the at least one subsequent scissor section 43.

Referring to FIGS. 1, 4 and 5, the at least one platform panel 55 is attached between the second crossbar 72 and the third crossbar 73 for each of the first scissor section 42 and the at least one subsequent scissor section 43. The at least one platform panel 55 is oriented parallel to the platform support arm 56 of the left scissor mechanism 40 and the platform support arm 56 of the right scissor mechanism 41.

As can be seen in FIGS. 1, 3, 4 and 5, the left cable 9 is operatively engaged, in order, with the railing pulley 101 of the left railing 12, the first pulley 50 of the first scissor section 42 of the left scissor mechanism 40, the second pulley 51 of the first scissor section 42 of the left scissor mechanism 40, the first pulley 50 of the at least one subsequent scissor section 43 of the left scissor mechanism 40, the second pulley 51 of the at least one subsequent scissor section 43 of the left scissor mechanism 40, and the first pulley 50 of the last scissor section 44 of the left scissor mechanism 40. The left cable 9 is also attached to the cable securing rod 57 of the last scissor section 44 of the left scissor mechanism 40. In other words, the left cable 9 is engaged with all the pulleys of the left scissor mechanism 40 and is secured so the last scissor section 44 of the left scissor mechanism 40.

Similarly, the right cable 10 is operatively engaged, in order, with the railing pulley 101 of the right railing 13, the first pulley 50 of the first scissor section 42 of the right scissor mechanism 41, the second pulley 51 of the first scissor section 42 of the right scissor mechanism 41, the first pulley 50 of the at least one subsequent scissor section 43 of the right scissor mechanism 41, the second pulley 51 of the at least one subsequent scissor section 43 of the right scissor mechanism 41, and the first pulley 50 of the last scissor section 44 of the right scissor mechanism 41. The right cable 10 is also attached to the cable securing rod 57 of the last scissor section 44 of the right scissor mechanism 41. In other words, the right cable 10 is engaged with all the pulleys of the right scissor mechanism 41 and is secured to the last scissor section 44 of the right scissor mechanism 41. The present invention is collapsed by applying a force to the left cable 9 and the right cable 10 in a direction toward the façade 100. The left cable 9 and the right cable 10 are made of appropriate material for sustaining the weight of the present invention and any users of the present invention. When the present invention is in the stored position, the ends of the left cable 9 and the right cable 10 opposite the cable securing rod 57 may be wound around a spool, which may be electrically operated by a motor or operated by hand, or by another method.

As seen in FIGS. 1 and 8, the plurality of ramp belt sections 6 comprises a plurality of first upper belt sections 61, a plurality of first lower belt sections 62, a plurality of second upper ramp belt sections 63, and a plurality of second lower belt sections 64. Each of the plurality of ramp belt sections 6 is made of an elastic or semi-elastic material that is strong enough to support the weight of a user without allowing the user to accidentally slip between the plurality of ramp belt sections 6 while sliding, but flexible enough to allow the user to force themselves through the plurality of belt sections in order to reach the next ramp.

The plurality of first upper belt sections 61 and the plurality of first lower belt sections 62 are positioned adjacent to each other and are oriented parallel to each other. The plurality of first upper belt sections 61 and the plurality of first lower belt sections 62 are attached in between the first crossbar 71 and the second crossbar 72, wherein the first crossbar 71 and the second crossbar 72 are positioned between the plurality of first upper belt sections 61 and the plurality of first lower belt sections 62. The plurality of first upper belt sections 61 are laterally spaced apart from each other, and the plurality of first lower belt sections 62 are also laterally spaced apart from each other. The plurality of first upper belt sections 61 and the plurality of first lower belt sections 62 are laterally staggered relative to each other, wherein a first gap between two of the plurality of first upper belt sections 61 is centrally positioned with one of the plurality of first lower belt sections 62 and a second gap between two of the plurality of first lower belt sections 62 is centrally positioned with one of the plurality of first upper belt sections 61.

Similarly, the plurality of second upper belt sections 63 and the plurality of second lower belt sections 64 are positioned adjacent to each other and are oriented parallel to each other. The plurality of second upper belt sections 63 and the plurality of second lower belt sections 64 are attached in between the second crossbar 72 and the first crossbar 71 of a next scissor section 300, wherein the next scissor section 300 is the at least one subsequent scissor section 43, or the next scissor section 300 is the last scissor section 44. The second crossbar 72 and the first crossbar 71 of the next scissor section 300 are positioned between the plurality of second upper belt sections 63 and the plurality of second lower belt sections 64.

The plurality of second upper belt sections 63 are laterally spaced apart from each other, and the plurality of second lower belt sections 64 are also laterally spaced apart from each other. The plurality of second upper belt sections 63 and the plurality of second lower belt sections 64 are laterally staggered relative to each other, wherein a third gap between two of the plurality of second upper belt sections 63 is centrally positioned with one of the plurality of second lower belt sections 64 and a fourth gap between two of the plurality of second lower belt sections 64 is centrally positioned with one of the plurality of second upper belt sections 63.

Each of the plurality of ramp belt sections 6 may be attached to one of the plurality of crossbars 7 by any appropriate means. For example, in one embodiment of the present invention, each of the plurality of ramp belt sections 6 is attached to one of the plurality of crossbars 7 by a plurality of metal rings attached between the ramp belt section and the crossbar in a manner similar to a shower curtain. In another embodiment of the present invention, a ramp belt is connected to a crossbar by forming a loop of fabric around the crossbar that is part of or attached to the ramp belt. In another embodiment of the present invention, a first ramp belt is connected to a crossbar by stitching the first ramp belt to an opposing second ramp belt, forming a loop around the crossbar. In another embodiment of the present invention, each of the plurality of ramp belts is a single entity being woven throughout the plurality of crossbars 7.

Although the invention has been explained in relation to its preferred embodiment, it is to be understood that many other possible modifications and variations can be made without departing from the spirit and scope of the invention as hereinafter claimed.

What is claimed is:

1. A deployable fire escape with multiple alternating ramps comprises:

a storage area;

a left fixed guide rail;

a right fixed guide rail;

a left scissor mechanism;

a right scissor mechanism;

a plurality of ramp belt sections;

a plurality of crossbars;

at least one platform panel;

a left cable;

a right cable;

the storage area comprises a deck support, a left railing and a right railing;

the left scissor mechanism and the right scissor mechanism each comprise a first scissor section, at least one subsequent scissor section, and a last scissor section;

the left fixed guide rail and the right fixed guide rail each comprise a guide channel, a horizontal portion, and a vertical portion;

the first scissor section, the at least one subsequent scissor section, and the last scissor section being pivotally connected to each other in series;

the horizontal portion being positioned within the storage area, the first scissor section, the at least one subsequent scissor section and the last scissor section each comprise a first pulley, an upper ramp support arm, and a roller pin;

the first scissor section and the at least one subsequent scissor section each further comprise a second pulley, a lower ramp support arm, and a platform support arm;

the last scissor section further comprises a cable securing rod;

the upper ramp support arm comprises a first upper arm end, a second upper arm end and a roller attachment location;

the lower ramp support arm comprises a first lower arm end and a second lower arm end;

the platform support arm comprises a first platform arm end and a second platform arm end;

the first upper arm end being positioned opposite the second upper arm end along the upper ramp support arm;

the roller attachment location being positioned adjacent to the second upper arm end opposite the first upper arm end;

the first lower arm end being positioned opposite the second lower arm end along the lower ramp support arm; and the first platform arm end being positioned opposite the second platform arm end along the platform support arm.

2. The deployable fire escape with multiple alternating ramps as claimed in claim 1 comprises:

the left scissor mechanism being pivotally engaged with the left fixed guide rail;

the left scissor mechanism being translationally engaged with the left fixed guide rail;

the right scissor mechanism being pivotally engaged with the right fixed guide rail; and the right scissor mechanism being translationally engaged with the right fixed guide rail.

3. The deployable fire escape with multiple alternating ramps as claimed in claim 1 comprises:

the left railing and the right railing being oriented parallel to each other;

the left railing and the right railing being perpendicularly attached to the deck support;

the horizontal portion being perpendicularly connected to the vertical portion, wherein the horizontal portion and the vertical portion form a right angle;

the horizontal portion being oriented parallel to the deck support;

the horizontal portion of the left fixed guide rail being attached to the deck support adjacent to the left railing;

the horizontal portion of the right fixed guide rail being attached to the deck support adjacent to the right railing; and the guide channel traversing continuously across the vertical portion and the horizontal portion.

4. The deployable fire escape with multiple alternating ramps as claimed in claim 1 comprises:

the left railing and the right railing each further comprise a plurality of railing supports, a hollow horizontal bar, and a railing pulley;

the plurality of railing supports being perpendicularly attached to the hollow horizontal bar; and the railing pulley being positioned within the hollow horizontal bar.

5. The deployable fire escape with multiple alternating ramps as claimed in claim 1 comprises:

the left cable being operatively engaged in series with a railing pulley of the left railing, the first pulley of the first scissor section of the left scissor mechanism, the second pulley of the first scissor section of the left scissor mechanism, the first pulley of the at least one subsequent scissor section of the left scissor mechanism, the second pulley of the at least one subsequent scissor section of the left scissor mechanism, and the first pulley of the last scissor section of the left scissor mechanism; and the right cable being operatively engaged in series with a railing pulley of the right railing, the first pulley of the first scissor section of the right scissor mechanism, the second pulley of the first scissor section of the right scissor mechanism, the first pulley of the at least one subsequent scissor section of the right scissor mechanism, the second pulley of the at least one subsequent scissor section of the right scissor mechanism, and the first pulley of the last scissor section of the right scissor mechanism.

6. The deployable fire escape with multiple alternating ramps as claimed in claim 1 comprises:

the roller pin comprises a first wheel and a second wheel;

the roller pin being positioned perpendicular to the upper ramp support arm;

the roller pin being positioned symmetrically across the upper ramp support arm at the roller attachment location, wherein the first wheel and the second wheel are symmetrically separated by the upper ramp support arm;

the first wheel of the left scissor mechanism and the second wheel of the left scissor mechanism being rollingly engaged inside the left fixed guide rail, wherein the roller pin of the left scissor mechanism holds the left scissor mechanism adjacent to the left fixed guide rail; and the first wheel of the right scissor mechanism and the second wheel of the right scissor mechanism being rollingly engaged inside the right fixed guide rail, wherein the roller pin of the right scissor mechanism holds the right scissor mechanism adjacent to the right fixed guide rail.

7. The deployable fire escape with multiple alternating ramps as claimed in claim 1 comprises:

the first upper arm end, the first lower arm end and the first platform arm end being pivotally connected to each other;

the first pulley being rotatably connected to the second upper arm end; and the second pulley being rotatably connected to the second platform arm end.

8. The deployable fire escape with multiple alternating ramps as claimed in claim 1 comprises:

the second upper arm end of the at least one subsequent scissor section being pivotally connected to the second lower arm end of a previous scissor section, wherein the at least one subsequent scissor section comprises a plurality of scissor sections, wherein the previous scissor section is the first scissor section or one of the plurality of subsequent scissor sections.

9. The deployable fire escape with multiple alternating ramps as claimed in claim 1 comprises:

the second upper arm end of the last scissor section being pivotally connected to the second end of the lower ramp support arm of a previous scissor section, wherein the at least one subsequent scissor section comprises a plurality of scissor sections, wherein the previous scissor section is one of the plurality of subsequent scissor sections.

10. The deployable fire escape with multiple alternating ramps as claimed in claim 1 comprises:

the plurality of crossbars being oriented parallel to each other;

the plurality of crossbars being oriented perpendicular to the left scissor mechanism and the right scissor mechanism;

the plurality of crossbars comprises a first crossbar, a second crossbar, and a third crossbar;

the first crossbar being rotatably connected in between the second upper arm end of the left scissor mechanism and the second upper arm end of the right scissor mechanism;

the second crossbar being rotatably connected in between the first upper arm end of the left scissor mechanism and the first upper arm end of the right scissor mechanism; and the third crossbar being rotatably connected in between the second platform arm end of the left scissor mechanism and the second platform arm end of the right scissor mechanism.

11. The deployable fire escape with multiple alternating ramps as claimed in claim 1 comprises:

the at least one platform panel being attached between a second crossbar and a third crossbar, wherein the at least one platform panel is oriented parallel to the platform support arm of the left scissor mechanism and the platform support arm of the right scissor mechanism.

12. The deployable fire escape with multiple alternating ramps as claimed in claim 1 comprises:

the left cable being attached to the cable securing rod of the last scissor section of the left scissor mechanism; and the right cable being attached to the cable securing rod of the last scissor section of the right scissor mechanism.

* * * * *